US007344373B2

(12) United States Patent
Vrolijk et al.

(10) Patent No.: US 7,344,373 B2
(45) Date of Patent: Mar. 18, 2008

(54) CONTROL METHOD FOR GAS BURNERS

(75) Inventors: Enno J. Vrolijk, Dalen (NL); Derk Vegter, Nieuw Amsterdam (NL)

(73) Assignee: Honeywell B.V., Amsterdam Z.O. (NL)

( * ) Notice: Subject to any disclaimer, the term of this patent is extended or adjusted under 35 U.S.C. 154(b) by 589 days.

(21) Appl. No.: 10/344,472

(22) PCT Filed: Aug. 14, 2001

(86) PCT No.: PCT/EP01/09379

§ 371 (c)(1),
(2), (4) Date: Jul. 15, 2003

(87) PCT Pub. No.: WO02/14744

PCT Pub. Date: Feb. 21, 2002

(65) Prior Publication Data

US 2004/0096789 A1 May 20, 2004

(30) Foreign Application Priority Data

Aug. 16, 2000 (DE) ..... 100 40 358

(51) Int. Cl.
*F23N 1/02* (2006.01)
*F23N 5/12* (2006.01)
*F23N 5/08* (2006.01)

(52) U.S. Cl. ..... 431/12; 431/25; 431/79; 340/579

(58) Field of Classification Search ..... 431/76, 431/12, 24, 25, 75, 77, 78, 79; 340/579
See application file for complete search history.

(56) References Cited

U.S. PATENT DOCUMENTS

| | | | | | |
|---|---|---|---|---|---|
| 4,519,771 | A | * | 5/1985 | Six et al. | 431/25 |
| 4,595,353 | A | * | 6/1986 | de Haan | 431/79 |
| 5,049,063 | A | * | 9/1991 | Kishida et al. | 431/78 |
| 5,632,614 | A | * | 5/1997 | Consadori et al. | 431/79 |
| 5,899,683 | A | | 5/1999 | Nolte et al. | 431/12 |
| 5,924,859 | A | * | 7/1999 | Nolte et al. | 431/12 |
| 5,961,314 | A | * | 10/1999 | Myhre et al. | 431/79 |
| 6,113,384 | A | * | 9/2000 | Sebastiani | 431/12 |

FOREIGN PATENT DOCUMENTS

| | | | |
|---|---|---|---|
| DE | 4433425 | A1 | 3/1996 |
| EP | 0962703 | | 12/1999 |
| GB | 2226163 | A | 6/1990 |
| WO | WO 97/36135 | A1 * | 10/1997 |

* cited by examiner

*Primary Examiner*—Josiah C. Cocks
(74) *Attorney, Agent, or Firm*—Klaus Stendel

(57) ABSTRACT

The invention relates to a control method for gas burners for providing a gas-air mixture.

According to the invention, the ionization signal is only used for setting the mixing ratio dependent on the gas quality when the burner flame completely sweeps over the sensor generating the ionization signal. Outside the above-mentioned range, i.e. when the burner flame does not completely sweep over the sensor generating the ionization signal, the gas-air mixture is controlled dependent on the previously determined mixing ratio.

12 Claims, 1 Drawing Sheet

CONTROL METHOD FOR GAS BURNERS

The invention relates to a control method for gas burners using a gas-air mixture.

Control methods for gas burners are used for providing a gas-air mixture, i.e. for supplying a gas flow and a combustion air flow to a burner.

In order to ensure an optimum and complete combustion of the fuel, i.e. the gas, within the gas burner, the latter has to be provided with an appropriately balanced gas-air mixture. The ratio between the gas flow and the combustion air flow, and between the gas pressure and the combustion air pressure, respectively, is referred to as mixing ratio or composition ratio.

However, since the quality of the gas provided by the gas supply varies—the quality of gas is defined by a so-called Wobbe index—, the gas-air mixture has to be appropriately varied dependent on the quality of the gas to ensure an optimum and complete combustion.

For making it possible to consider the quality of the provided gas, the prior art discloses control methods according to which an ionization signal of a sensor, in particular of a measuring electrode projecting into the burner flame of the gas burner, is used for adapting the gas-air mixture to different gas qualities. In this respect, it can be referred to the DE-A-44 33 425, DE 39 37 290 A1, as well as to the DE 195 39 568 C1.

In the known control methods for gas burners according to which an ionization signal is used, this ionization signal is used over the whole operating range of the burner for adapting the gas-air mixture to different gas qualities. However, when the operating loads of the burner are low, the ionization signal strongly depends on external influences and consequently does not provide any reliable information on the combustion conditions actually prevailing in the burner. Accordingly, the control methods according to the prior art lead to an instable and, thus, insufficient control.

Starting out from this, the present invention is based on the problem of providing an improved control method for gas burners. According to the invention, the problem is solved by a control method comprising using an ionization signal of a sensor for setting a mixing ratio of the gas-air mixture when the burner flame sweeps over the sensor, and setting the mixing ratio of the gas-air mixture based on, for example, a previously determined mixing ratio when the burner flame does not sweep over the sensor.

Figure 1:
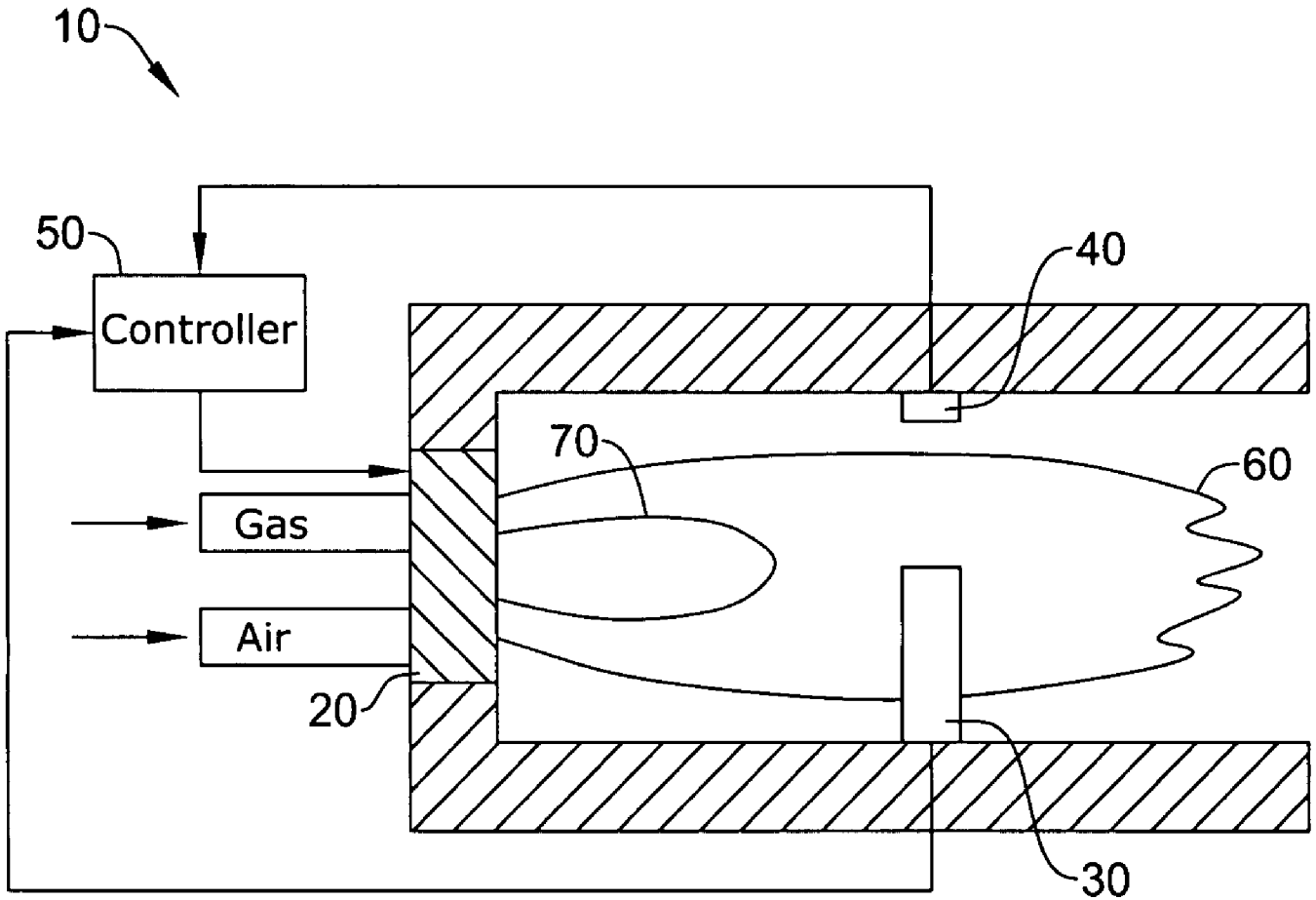
FIG. 1 is a schematic depiction of a controller assembly according to one illustrative embodiment of the present invention.

Preferred further developments of the invention result from the subclaims and the description.

The control method for gas burners is used for providing a gas-air mixture for a burner. For this purpose, a gas flow and a combustion air flow are supplied to the burner. The ratio between gas flow and combustion air flow, and the ratio between gas pressure and combustion air pressure, respectively, is referred to as mixing ratio.

The combustion process in the burner is monitored by means of a sensor generating an ionization signal. Information on the combustion process and, thus, on the existing gas quality can be obtained from the ionization signal.

An illustration of a burner and controller assembly 10 is shown in FIG. 1. Gas and air flow is provided to a burner 20 that produces a flame 60 when the burner is operating in a first state. A flame 70 is produced when the burner 20 is operating in a second state. Sensor 30 provides an ionization signal to the controller 50. An optical monitor 40 may be included to provide a signal to the controller 50, indicating whether or not the flame 60 is currently sweeping across the sensor 30.

According to the invention, the ionization signal is used for setting the mixing ratio dependent on the gas quality exclusively when the burner flame completely sweeps over the sensor generating the ionization signal. The underlying idea of this feature according to the invention is that the ionization signal provides a reliable information on the combustion process only during this working or operating state of the burner.

Outside the above-mentioned range, i.e. when the burner flame does not completely sweep over the sensor generating the ionization signal, the gas-air mixture is controlled dependent on the previously determined mixing ratio.

The condition whether or not the burner flame completely sweeps over the sensor generating the ionization signal can, for example, be verified by an additional optical flame monitoring means.

What is claimed is:

1. A control method for providing a gas flow and a combustion air flow in a gas-air mixture to a burner to produce a burner flame, and for using a sensor that produces an ionization signal to adapt the gas-air mixture to different gas qualities, the method comprising the steps of:

optically determining when the burner flame sweeps over the sensor;

using the ionization signal of the sensor for setting a mixing ratio of the gas-air mixture when the burner flame sweeps over the sensor; and setting the mixing ratio of the gas-air mixture based on the gas flow and the combustion air flow when the burner flame does not sweep over the sensor.

2. A control method according to claim 1 wherein the ionization signal of the sensor is used for setting the mixing ratio of the gas-air mixture when the burner flame completely sweeps over the sensor, and the mixing ratio of the gas-air mixture is set based on the gas flow and the combustion air flow when the burner flame does not completely sweep over the sensor.

3. A controller for controlling a gas flow and a combustion air flow in a gas-air mixture for a gas burner to produce a burner flame, the gas burner including a sensor adjacent the gas burner, the controller receiving an ionization signal from the sensor and sets the gas-air mixture based, at least in part, on the ionization signal when the burner flame sweeps over the sensor, and sets the gas-air mixture based on the gas flow and the combustion air flow when the burner flame does not sweep over the sensor, the controller further including an optical flame monitor for monitoring when the burner flame does or does not sweep over the sensor.

4. A control method according to claim 1 wherein the ionization signal of the sensor is used for setting the mixing ratio of the gas-air mixture when the burner flame completely sweeps over the sensor, and said mixing ratio is used to control the gas-air mixture when the burner flame does not completely sweep over the sensor.

5. A combustion burner controller that adapts a gas-air mixture to different gas qualities, the controller comprising:

a combustion burner providing gas and air flow to a burner to produce a flame;

a sensor that provides an ionization signal based on the combustion process in the burner, the sensor positioned adjacent the burner flame such that when the burner is in a first operating state, the flame sweeps completely over the sensor and when the burner is in a second operating state, the flame does not sweep completely over the sensor;

an optical monitor positioned adjacent the flame, the optical monitor providing a signal indicating the burner flame is or is not sweeping over the sensor;

a controller that sets a gas-air mixture ratio based on the ionization signal, wherein the gas-air mixture is dependent at least in part on the gas quality;

wherein the controller sets the gas-air mixture ratio when the burner is in the first operating state, and uses that gas-air mixture ratio when the burner is in the second operating state.

6. A control method for providing a gas flow and a combustion air flow in a gas-air mixture to a burner to produce a burner flame, and for using a sensor that produces an ionization signal to adapt the gas-air mixture to different gas qualities, the method comprising the steps of:

optically determining when the burner flame completely sweeps over the sensor;

using the ionization signal of the sensor for setting a mixing ratio of the gas-air mixture when the burner flame completely sweeps over the sensor; and setting the mixing ratio of the gas-air mixture based on the gas flow and the combustion air flow when the burner flame does not sweep over the sensor.

7. A control method for providing a gas flow and a combustion air flow in a gas-air mixture to a gas burner to produce a burner flame, the method comprising the steps of:

optically determining when an operating load of the burner is in a first state and when the operating load is in a second state;

accepting an ionization signal from a sensor, wherein the sensor is positioned in the burner flame when the operating load of the burner is in a first state and at least not completely positioned in the burner flame when the operating load of the burner is in a second state;

using, at least in part, the ionization signal of the sensor for controlling the gas-air mixture to the burner when the operating load is in the first state; and using a measure of the gas flow and combustion air flow for controlling the gas-air mixture to the burner when the operating load is in the second state.

8. A control method according to claim 7 wherein, in the first state, the burner flame completely sweeps over the sensor, and in the second state, the burner flame does not completely sweep over the sensor.

9. A control method according to claim 7 wherein the determining step determines when the operating load of the burner is in the first state by determining when the burner flame completely sweeps over the sensor.

10. A control method according to claim 9 wherein the determining step determines when the operating load of the burner is in the second state by determining when the burner flame does not completely sweep over the sensor.

11. A method for managing the combustion of fuel in a gas burner in which a controller controls the mixture of gas and air to produce a burner flame, the method comprising the steps of:

providing an ionization sensor positioned such that when the burner is in a first operating state, the burner flame sweeps over the sensor, and when the burner is in a second operating state, the burner flame does not completely sweep over the sensor;

providing an optical flame monitor coupled to the controller for monitoring when the burner flame does or does not completely sweep over the sensor;

providing an ionization signal to the controller when the burner is in the first operating state; and using the ionization signal to set a mixing ratio for a gas-air mixture;

wherein when the burner is in the second operating state, maintaining the mixing ratio set when the burner was in the first operating state.

12. The method of claim 11, wherein the ionization signal is only used to set a mixing ratio for a gas-air mixture when the burner is in the first operating state.

* * * * *